US006230807B1

(12) United States Patent
Patel

(10) Patent No.: US 6,230,807 B1
(45) Date of Patent: May 15, 2001

(54) VALVE OPERATING MECHANISM

(75) Inventor: Dinesh R. Patel, Sugar Land, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 09/042,926

(22) Filed: Mar. 17, 1998

Related U.S. Application Data

(60) Provisional application No. 60/041,108, filed on Mar. 19, 1997.

(51) Int. Cl.[7] ..... E21B 34/10

(52) U.S. Cl. ..... 166/321; 166/240; 166/331

(58) Field of Search ..... 166/321, 240, 166/319, 331

(56) References Cited

U.S. PATENT DOCUMENTS

| | | | | |
|---|---|---|---|---|
| 3,768,506 | * | 10/1973 | McGill | 137/458 |
| 3,814,182 | * | 6/1974 | Giroux | 166/226 |
| 3,835,925 | * | 9/1974 | Mott | 166/218 |
| 3,976,136 | * | 8/1976 | Farley et al. | 166/264 |
| 3,986,553 | * | 10/1976 | Klyen | 166/164 |
| 4,113,012 | * | 9/1978 | Evans et al. | 166/331 |
| 4,144,937 | * | 3/1979 | Jackson et al. | 166/314 |
| 4,215,746 | | 8/1980 | Hallden et al. | 166/53 |
| 4,280,561 | | 7/1981 | Fredd | 166/332.4 |
| 4,356,867 | | 11/1982 | Carmody | 166/373 |
| 4,373,587 | | 2/1983 | Pringle | 166/324 |
| 4,403,659 | | 9/1983 | Upchurch | 166/374 |
| 4,417,600 | | 11/1983 | Kohn | 137/553 |
| 4,420,045 | | 12/1983 | McMahan | 166/334.2 |
| 4,467,867 | * | 8/1984 | Baker | 166/188 |
| 4,576,235 | | 3/1986 | Slaughter et al. | 166/374 |
| 4,627,492 | | 12/1986 | MacLaughlin | 166/250.08 |
| 4,657,082 | * | 4/1987 | Ringgenberg | 166/331 |
| 4,676,307 | * | 6/1987 | Pringle | 166/322 |
| 4,693,314 | | 9/1987 | Wesson et al. | 166/317 |
| 4,979,569 | | 12/1990 | Anyan et al. | 166/374 |
| 5,058,673 | | 10/1991 | Muller et al. | 166/187 |
| 5,090,481 | | 2/1992 | Pleasants et al. | 166/373 |
| 5,263,683 | | 11/1993 | Wong | 251/145 |
| 5,333,731 | * | 8/1994 | Ringgenberg et al. | 166/336 |
| 5,337,827 | | 8/1994 | Hromas et al. | 166/321 |

(List continued on next page.)

FOREIGN PATENT DOCUMENTS

| | | |
|---|---|---|
| 0775803 | 5/1997 | (EP) . |
| 2 213 181 | 8/1989 | (GB) . |
| 2214540 | 9/1989 | (GB) . |

OTHER PUBLICATIONS

Schlumberger, *Formation Isolation Valve* (*FIV*), p. 1 (Jan. 1997).
Schlumberger, *Liner Top Isolation Valve—LTIV*, p. 1 (Publication Date Unknown).
Schlumberger, *Formation Isolation Valve* (*FIV*), p. 1 (Aug. 1997).
Schlumberger, *Liner Top Isolation Valve—(LTIV*)*, p. 1 (Sep. 1997).
Schlumberger, *Iris* Operated Dual Valve* (*IRDV–AB*), p. 1 (Oct. 1997).

(List continued on next page.)

*Primary Examiner*—Thomas B. Will
*Assistant Examiner*—John Kreck
(74) *Attorney, Agent, or Firm*—Trop, Pruner & Hu PC

(57) ABSTRACT

Apparatus and method for operating a valve positioned in a wellbore. The apparatus includes a tubing having a bore and a piston operably coupled to the valve. The piston is moveable from a first position to the second position by predetermined pressure applied from fluid in the tubing bore. A counter mechanism coupled to the piston prevents movement of the piston to the second position until the predetermined pressure has been applied a first number of times.

27 Claims, 7 Drawing Sheets

U.S. PATENT DOCUMENTS

| | | | | |
|---|---|---|---|---|
| 5,518,073 | | 5/1996 | Manke et al. | 166/240 |
| 5,529,126 | * | 6/1996 | Edwards | 166/331 |
| 5,609,178 | * | 3/1997 | Henning et al. | 137/10 |
| 5,664,629 | | 9/1997 | Maitland | 166/373 |
| 5,810,087 | | 9/1998 | Patel | 166/373 |
| 5,819,853 | * | 10/1998 | Patel | 166/373 |
| 5,890,542 | * | 4/1999 | Ringgenberg | 166/374 |
| 5,906,220 | * | 5/1999 | Thompson | 166/321 |

OTHER PUBLICATIONS

Schlumberger, *Single–Shot Reversing Valve* (*SHRV*), p. 1 (Dec. 1996).

U.S. patent application No. 08/762,762, entitled *Surface Controlled Formation Isolation Valve Adapted for Deployment of a Desired Length of a Tool String in Wellbore*, filed Dec. 10, 1996.

U.S. patent application No. 09/034,206, entitled *Inflatable Shifting Tool*, filed Mar. 3, 1998.

* cited by examiner

VALVE OPERATING MECHANISM

CROSS REFERENCE TO RELATED APPLICATIONS

This application claims the benefit of under 35 U.S.C. §119(e)(1) of U.S. Provisional Application Ser. No. 60/041,108, filed Mar. 19, 1997, entitled "FORMATION ISOLATION VALVE (FIV) WITH TRIPLESS COUNTER OPERATOR";

This application further claims the benefit under 35 U.S.C. §120 of U.S. patent application Ser. No. 08/646,673, filed May 10, 1996, now U.S. Pat. No. 5,810,087, entitled "FORMATION ISOLATION VALVE ADAPTED FOR BUILDING A TOOL STRING OF ANY DESIRED LENGTH PRIOR TO LOWERING THE TOOL STRING DOWNHOLE FOR PERFORMING A WELLBORE OPERATION", and U.S. patent application Ser. No. 08/762,762, now U.S. Pat. No. 6,085,845, filed Dec. 10, 1996, entitled "SURFACE CONTROLLED FORMATION ISOLATION VALVE ADAPTED FOR DEPLOYMENT OF A DESIRED LENGTH OF A TOOL STRING IN WELLBORE".

BACKGROUND

The invention relates to a valve operating mechansim.

In a wellbore, one or more valves can be used to control flow of fluid between different sections of the wellbore. Such valves are typically referred to as formation isolation valves. A formation isolation valve can include a ball valve that is controllable with a shifting tool lowered into the wellbore. For example, the shifting tool can be attached to the end of a tool string (e.g., perforating string). The shifting tool engages a valve operator that is operably coupled to the valve to rotate the valve between the open and close positions.

In addition to use of a shifting tool, such valves can also be operated remotely, such as by application of fluid pressure from the surface to a valve. In addition to valves, other equipment may also be located downhole. Such equipment may also be operable by fluid pressure applied down the wellbore. Thus, a need arises for a mechanism that can prevent actuation of a valve when such fluid pressure is applied to operate the other equipment.

SUMMARY

In general, in one aspect, the invention features an apparatus for operating a valve positioned in a wellbore. The apparatus includes a tubing having a bore and a piston operably coupled to the valve. The piston is moveable from a first position to the second position by predetermined pressure applied from fluid in the tubing bore. A counter mechanism coupled to the piston prevents movement of the piston to the second position until the predetermined pressure has been applied a first number of times.

Other features will become apparent from the following description and from the claims.

DETAILED DESCRIPTION

Figure 1:
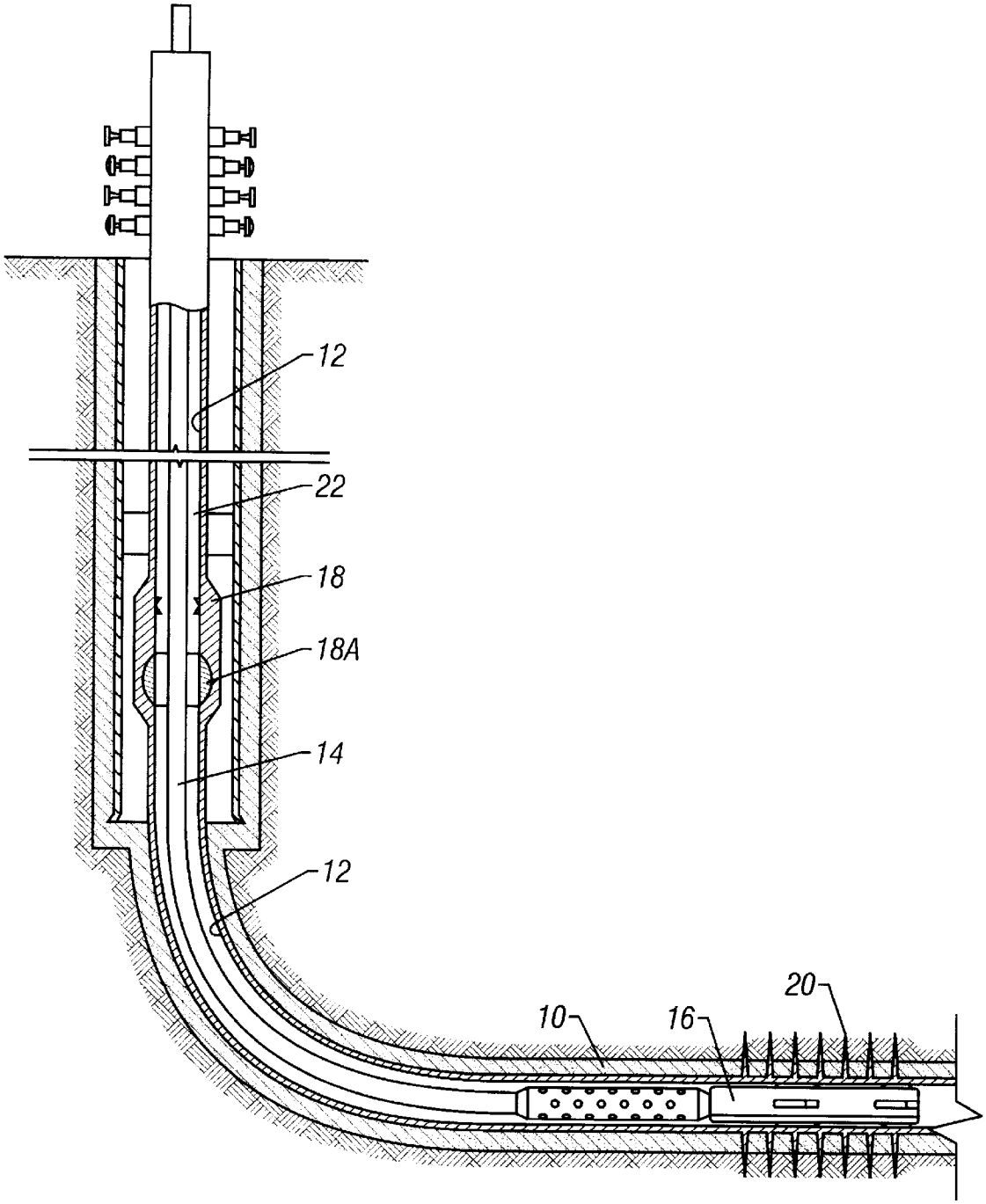
FIG. 1 is a diagram of a wellbore having a formation isolation valve.

Referring to FIG. 1, a wellbore 12 having a vertical section and a deviated section is shown. Casing 6 is cemented to the inner wall of the wellbore 12. A tubing string 14, connected to surface equipment, extends through both the vertical and deviated portions of the wellbore 12. A formation isolation valve (FIV) 18 is connected to the tubing string 14 at a predetermined location. In one embodiment, the FIV 18 includes a ball valve 18*a* and a valve operator mechanism 18*b*. The operator mechanism 18*b* can be actuated to open and close the valve 18*a*. When closed, the ball valve 18*a* prevents fluid communication between the upper and lower sections of the wellbore 12.

A tool string (e.g., a perforating string 10) can be lowered on a coiled tubing 14 into the bore of the tubing string 14 and through the bore of the FIV 18. Connected at the bottom end of the perforating string 10 is a shifting tool 16 used to engage the operator mechanism 18*b* to actuate the ball valve 18*a*. The shifting tool 16 can be used to repeatedly open and close the valve 18*a*.

The FIV 18 can be actuated remotely from the surface using fluid pressure communicated down the tubing string 14 to the FIV 18. By allowing this remote actuation, a trip downhole to open the valve 18*a* can be avoided. According to an embodiment of the invention, the FIV 18 includes a counter section 200 (FIG. 5B) that can be set to actuate the valve operator mechanism 18*b* after a predetermined number of pressure cycles. One advantage offered by using the counter section 200 is that pressure cycles can be used to activate other equipment downhole or to perform tests without actuating the ball valve 18*a*.

Figure 2:
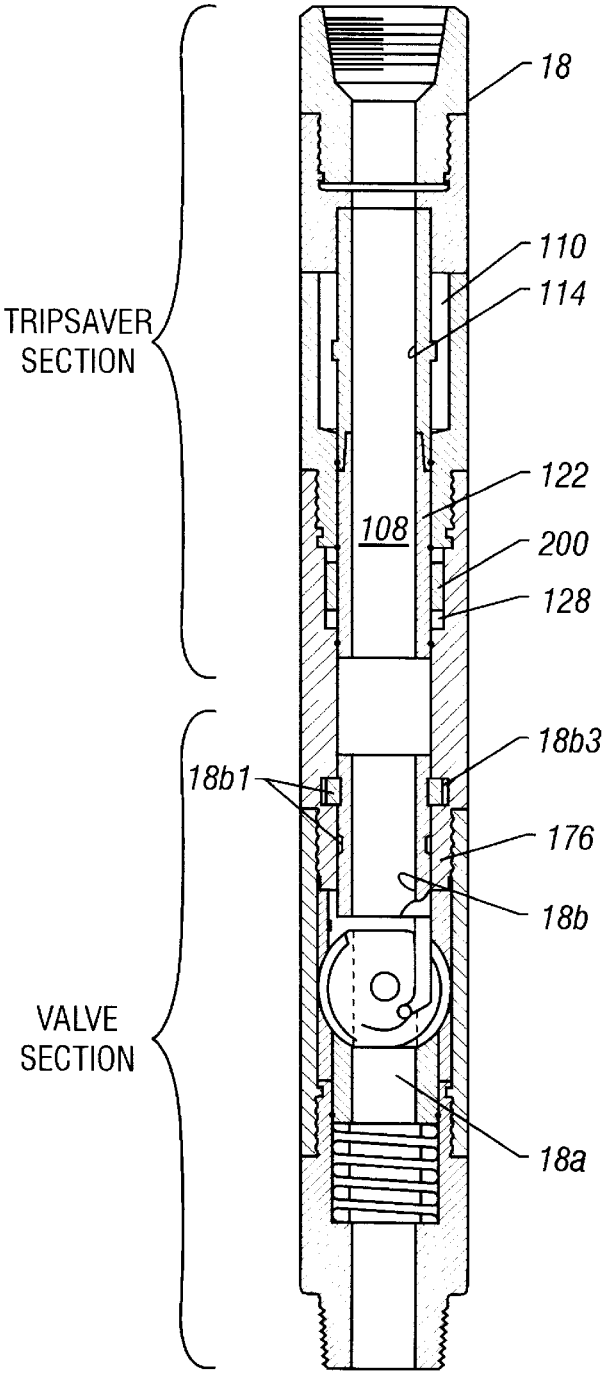
FIGS. 2–4 are diagrams of a formation isolation valve.
Figure 3:
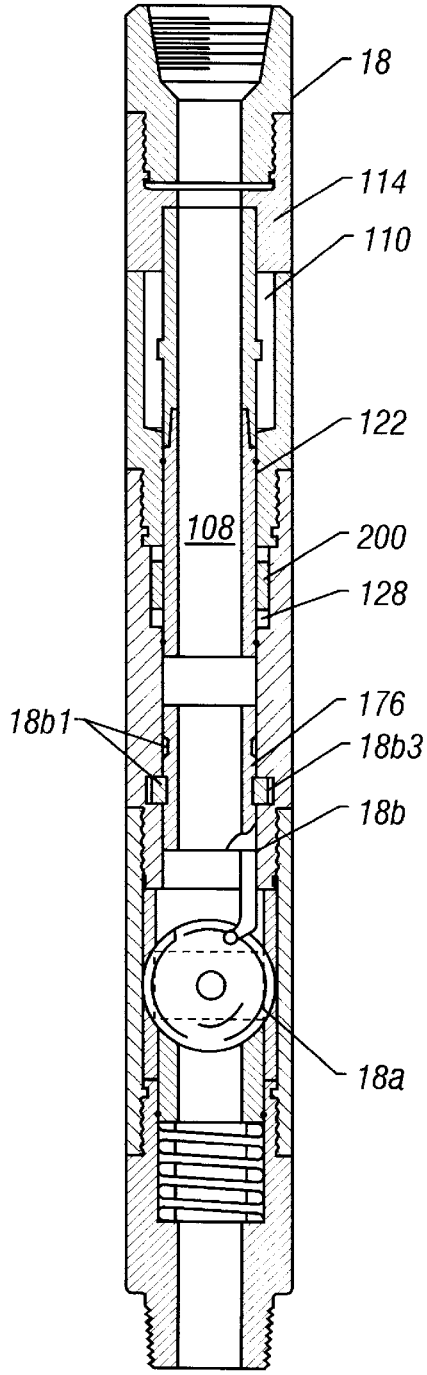
Figure 4:
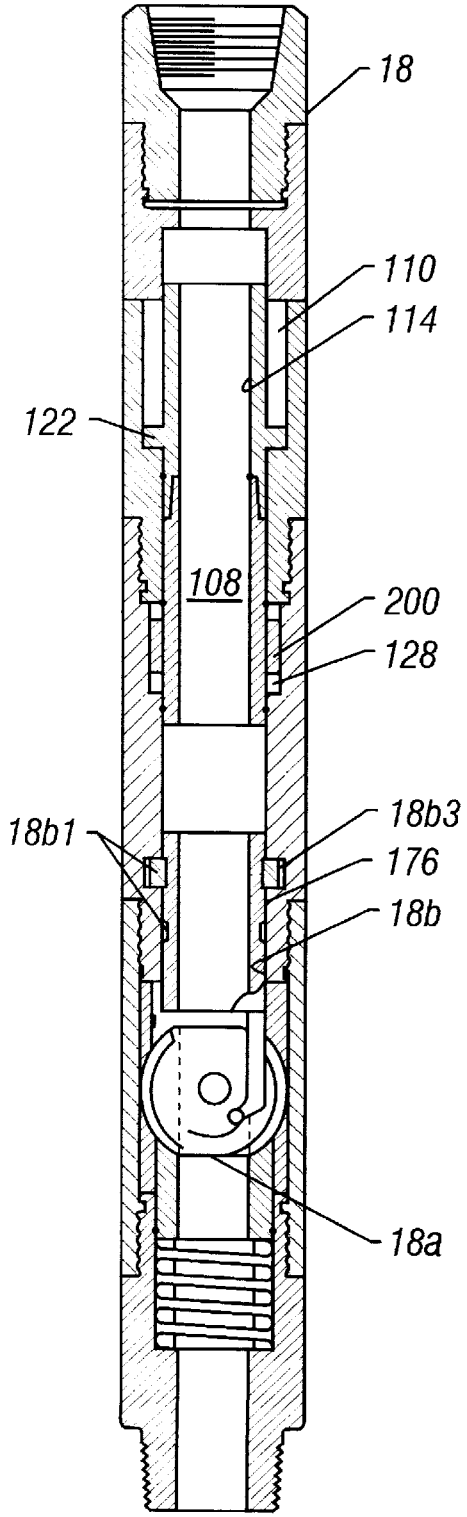

Referring to FIGS. 2–4, portions of the FIV 18, including a tripsaver section and a valve section, are illustrated. FIG. 2 shows the FIV 18 in its initial run-in position, FIG. 3 shows the FIV 18 in its closed position, and FIG. 4 shows the FIV 18 in its re-opened position.

The ball valve 18*a* is connected to a ball operator 18*b*, which includes a pair of grooves 18*b*1 in which a detent 18*b*3 is disposed. An upward longitudinal movement of the ball operator 18*b* (such as in response to engagement of a shifting tool as the tool is being raised out of the wellbore) will cause the detent 18*b*3 to move out of one groove and fall into the other groove of the pair of grooves 18*b*1. The ball operator 18*b* will then rotate the ball valve 18*a* from the run-in open position in FIG. 2 to the closed position in FIG. 3.

The tripsaver section of the FIV 18 includes an operator mandrel 114, a gas chamber 110, a power mandrel 122, a fluid chamber 128, and a counter section 200. The gas chamber 110 includes a preselected gas (e.g., nitrogen), which defines a reference pressure. Fluid in the tubing string 14 can be communicated through the FIV bore 108 to the fluid chamber 128, which applies an upward pressure on the power mandrel 122. When the fluid pressure exceeds the gas pressure, the power mandrel 122 moves up along with the operator mandrel 114. When fluid is bled from the tubing string 14 the fluid pressure drops and the power mandrel 122 is pushed back down. Each up and down movement of the power mandrel 122 makes up a cycle. After a predetermined number of cycles, the counter section 200 is activated to allow the bottom of the power mandrel 122 to contact the top part of a latch mandrel 176 in the valve operator 18*b*, as shown in FIG. 4. The downward movement of the valve operator 18*b* will cause the ball valve 18*a* to rotate from its closed position (FIG. 3) to its open position (FIG. 4). This cycled actuation of the ball valve 18*a* can be repeated.

In the configuration shown in FIG. 4, the latch mandrel 176 of the valve operator 18*b* engages the power mandrel 122 to open the valve 18*a*. The counter mechanism 200 acts to engage and disengage the latch mandrel 176 from the power mandrel 122. The counter mechanism allows engagement of the power mandrel 122 with the latch mandrel 176 after the power mandrel is operated a certain number of up and down cycles. The nitrogen gas provides power for moving the power mandrel 122 down against the tubing pressure.

The nitrogen gas chamber can be pre-charged at the surface to certain pressures to give a desired downhole reference pressure or a separate reference tool can be run which will allow the nitrogen gas reference pressure to equalize with the hydrostatic pressure and then isolate the nitrogen gas reference pressure from the tubing pressure.

Figure 5A:
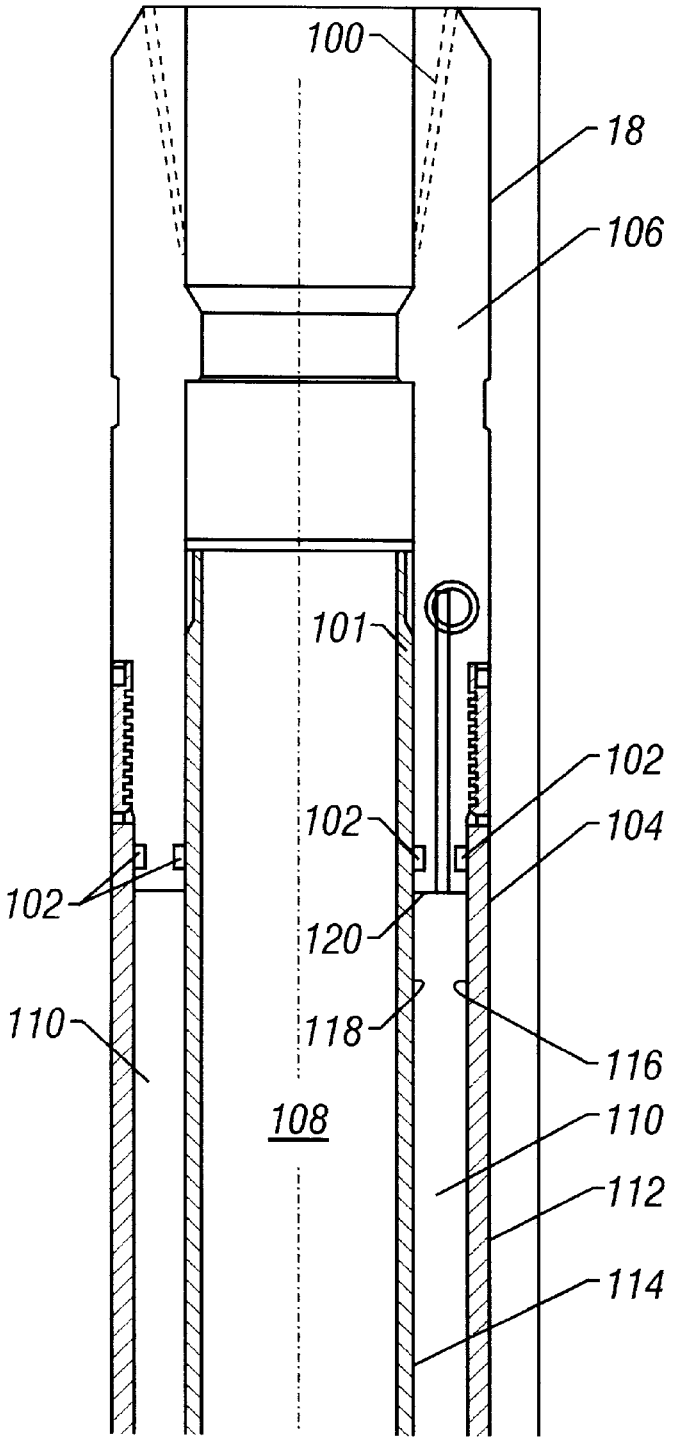
FIGS. 5A–5B are a cross-section of portions of the formation isolation valve.
Figure 5B:
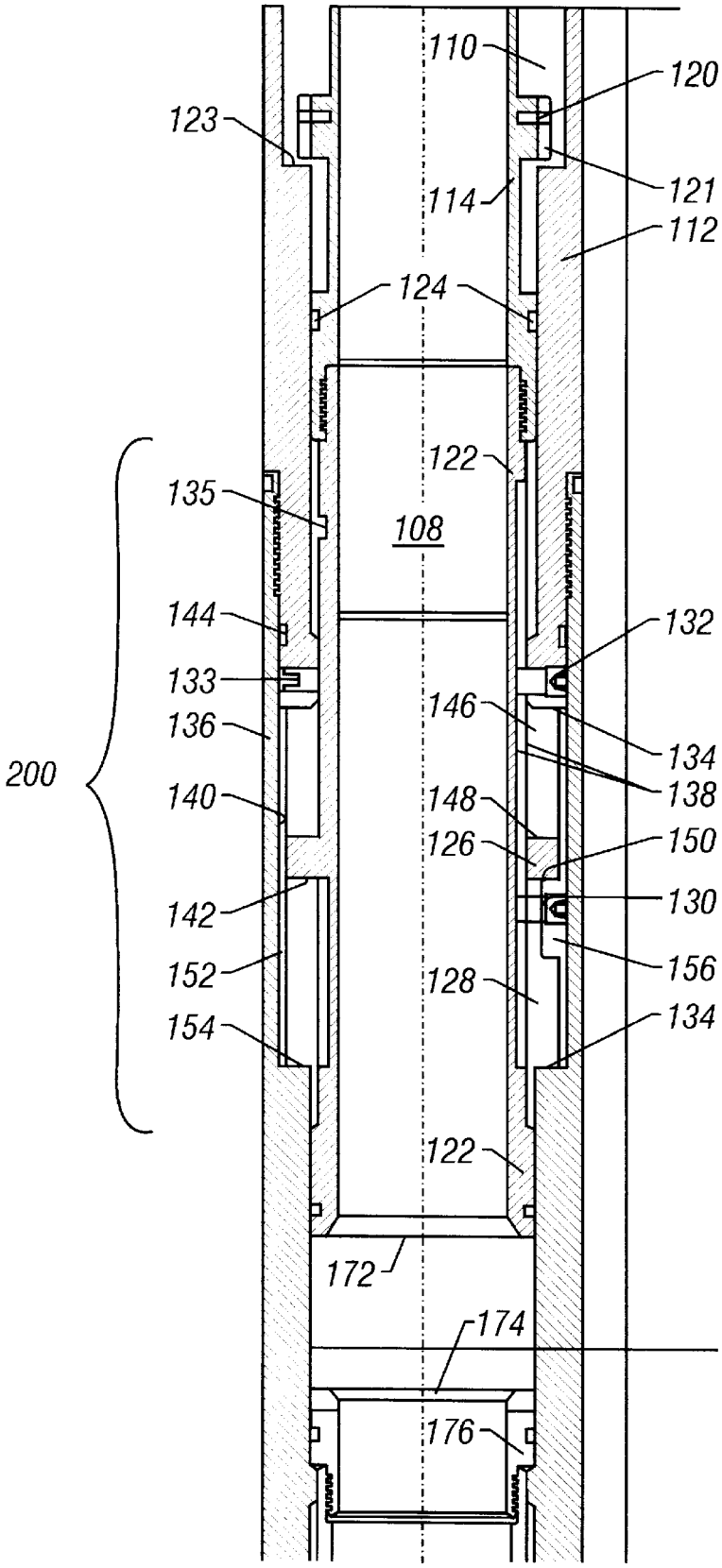

Referring to FIGS. 5A–5B, the FIV 18 includes a valve section (containing the valve 18*a* and valve operator 18*b*) and a tripsaver section (containing a power mandrel 122 and a counter section 200). In FIG. 5A, the top part of the FIV 18 includes a top sub section 106 that has a threaded opening for connecting to the tubing string 14. The FIV 18 has an axial bore 108 through which a tool string can pass. The top sub section 106 is threadably connected to a first housing section 112. An operator mandrel 114 is located inside the first housing section 112. A chamber 110 is defined by the outer wall 118 of the operator mandrel 114, the inner wall 116 of the first housing section 112, and the bottom face 134 of the top sub section 106. The chamber can be filled with nitrogen or other suitable gas to define a reference pressure for remote operation of the FIV 18. O-ring seals 102 are used to seal the gas chamber 110.

In FIG. 5B, the operator mandrel 114 is threadably connected to a power mandrel 122, and the first housing section 112 is threadably connected to a middle housing section 136. A fluid chamber 128 is defined between the inner wall 140 of the middle housing section 136 and the outer wall 138 of the power mandrel 122. The fluid chamber 128 fills with fluid that exists in the bore 108 of the FIV 18. Thus, fluid pressure applied from the surface can be communicated through the bore of the tubing string 14 to the fluid chamber 128 and applied to the area formed between the O-ring seal 124 and the inner diameter of the operator mandrel 114. The bottom surface 142 of a flange portion 126 of the power mandrel 122 initially sits on a shoulder 150 of a protruding section 156 of a spline sleeve 152.

If the fluid chamber pressure exceeds the reference pressure of the gas chamber 110, then the power mandrel is pushed up (or to the left of the page on FIG. 5B). The power mandrel 122 can travel the distance defined by a gap 146 until the top surface 148 of a flange portion 126 bumps up against the bottom face 134 of the first housing section 112. An O-ring seal 124 prevents fluid communication between the fluid chamber 128 and the gas chamber 110, and an O-ring seal 144 prevents fluid communication from outside the housing of the FIV 18.

When the power mandrel 122 is pushed to its up position, half a power cycle has occurred. When fluid pressure in the FIV bore 108 is next bled off at the surface until the gas chamber reference pressure exceeds the fluid chamber pressure, the power mandrel 122 drops back down until the bottom surface 142 of a flange portion 126 hits the shoulder 150 defined by a protruding section 156 of the spline sleeve 152. Each up and down motion of the power mandrel 122 defines one cycle of the counter section 200.

Figure 7:
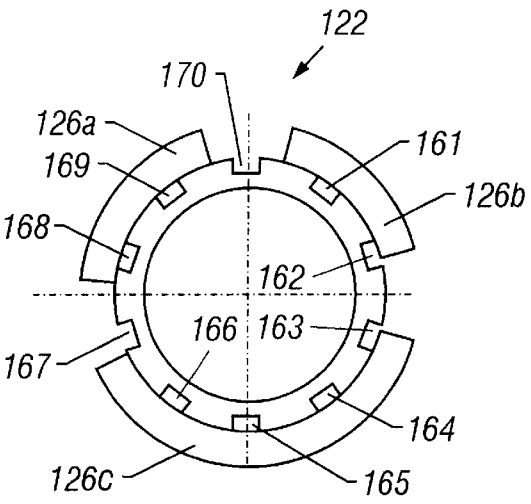
FIG. 7 is a cross-sectional view of a power mandrel used in the counter mechanism in the formation isolation valve.
Figure 8:
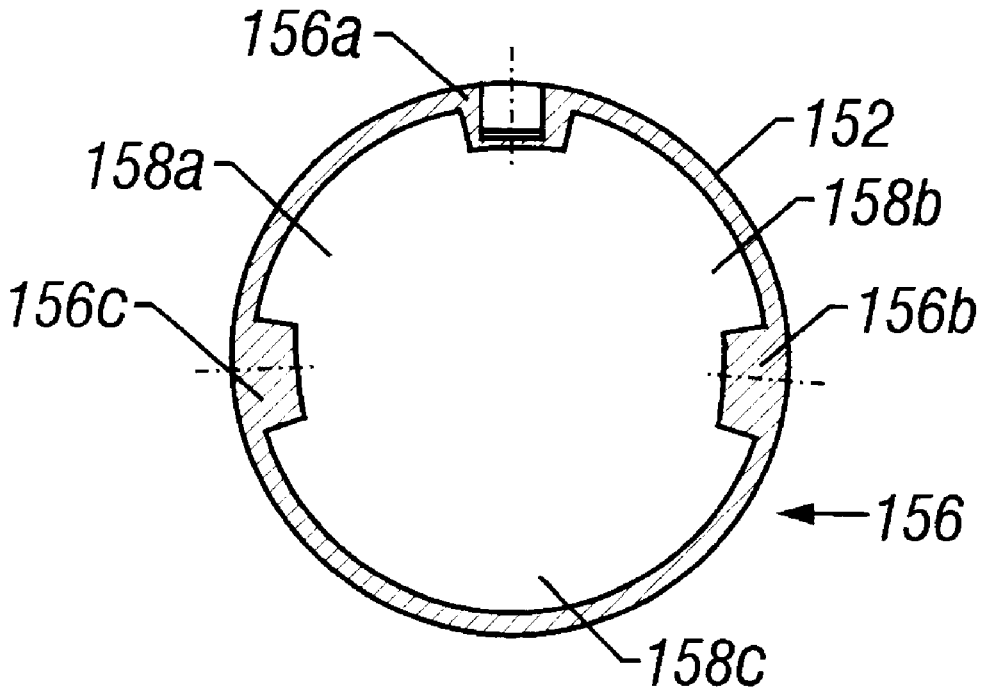
FIG. 8 is a cross-sectional view of a spline sleeve used in the counter mechanism in the formation isolation valve.

After a predetermined number of cycles, the counter section 200 of the FIV 18 is activated to allow the power mandrel 122 to move down past a protruding section 156 of the spline sleeve 152. The spline sleeve 152 is rotatable with respect to the power mandrel 122. Each up and down cycle of the power mandrel 122 causes the spline sleeve 152 to rotate a certain distance. In one embodiment, as shown in FIG. 7, the power mandrel includes three flange portions 126A–C. As shown in FIG. 8, the spline sleeve 152 includes three protruding sections 156A–C. After a predetermined number of cycles, gaps 158A–C between the protruding sections 156A–C line up with the flange sections 126A–C, allowing the power mandrel 122 to move down past the protruding sections 156 toward the shoulder 137 of the middle housing section 136 (after shear pins 120 are sheared as discussed further below).

A J-slot pin 130 is inserted through the spline sleeve 152 to move in a step-wise fashion along J slots defined in the outer wall 138 of the power mandrel 122 as the spline sleeve 152 is rotated. As the spline sleeve 152 rotates, the J-slot pin 130 travels along a path defined by the J slots generally along the circumference of the power mandrel outer wall 138, as shown in FIG. 6.

Figure 6:
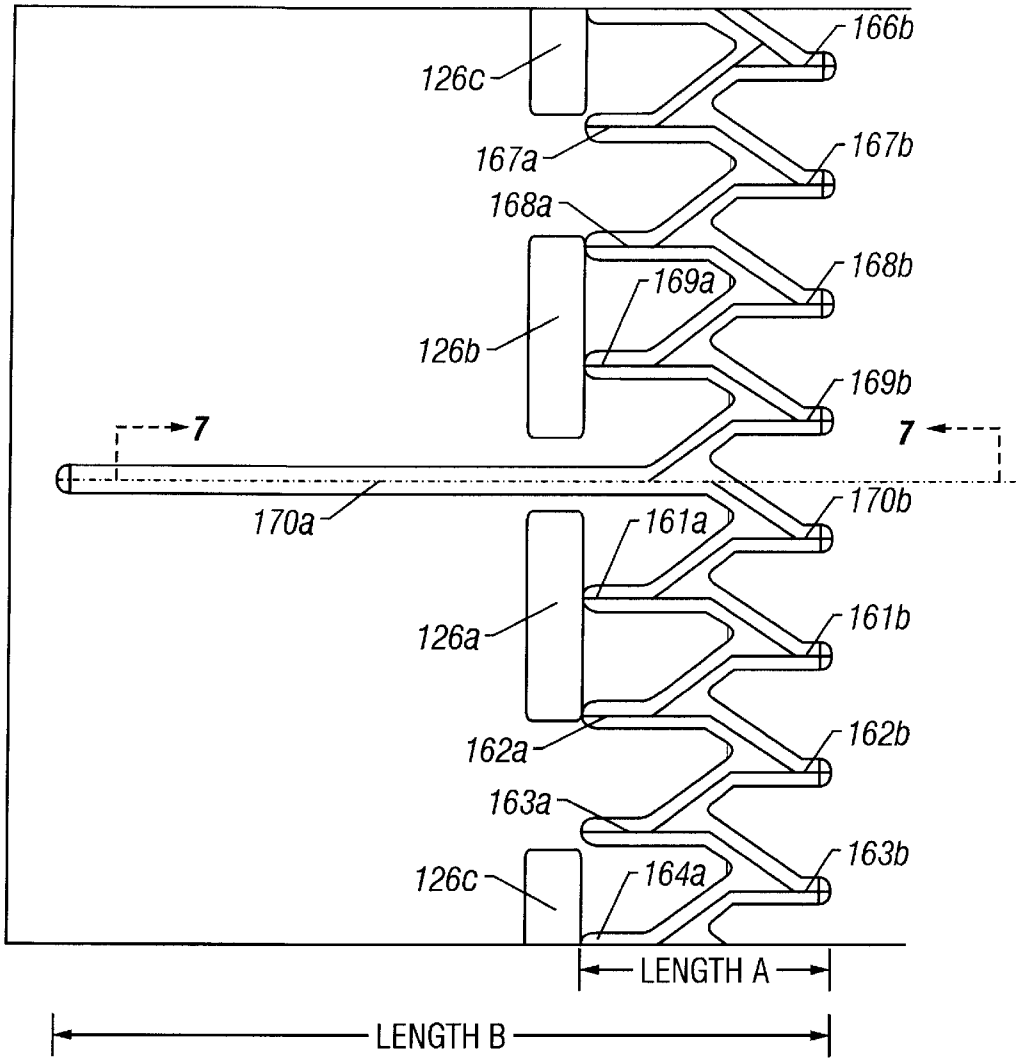
FIG. 6 is a diagram of J slots used in a counter mechanism in the formation isolation valve.

As illustrated in the different views of FIGS. 6 and 7, there are 10 J slots 161, 162, 163, 164, 165, 166, 167, 168, 169, and 170 in the power mandrel 122. J slots 161–169 are of the same length (length A), and J slot 170 is of a longer length (length B). The shorter length J slots allow movement of the power mandrel 122 in an up and down fashion along length A, but such movement does not allow the power mandrel to engage the ball valve operator 18*b*. The J-slot pin 130 of the rotating spline sleeve 152 is rotatingly urged along adjacent J slots with each cycle of the power mandrel 122. The single long length counter track engagement J slot 170 is designed to allow sufficient movement along length B of the power mandrel to allow the power mandrel 122 to engage the valve operator 18*b* sufficiently to operate on the valve 18*a*. A fixed J-slot pin 132 contained in the first housing section 112 remains tracking in the engagement slot 170 as the spline sleeve 152 rotates and the J-slot pin 130 moves between different J slots.

In operation, the J-slot pin 130 can initially be located in slot 161A. When the power mandrel 122 is pushed up by fluid pressure, the J-slot pin 130 travels along the path from the slot 161A to 161B. When the power mandrel 122 moves back down again after fluid pressure is removed, the J-slot pin 130 travels along the path defined from slot 161B to slot 162A. This is repeated until the J-slot pin 130 reaches slot 169B. On the next down cycle of the power mandrel 122, the flange portions 126A–C line up with the gaps 158A–C, which then allows the J-slot pin 130 to travel along the extended slot 170A as the power mandrel 122 moves down toward the shoulder 137 of the middle housing section 136.

When the operator mandrel 114 moves down to actuate the valve 18*a*, an opening 101 in the operator mandrel 114 moves down to allow the gas chamber 110 to communicate with the inner bore 108 of the FIV 18. As a result, the gas (e.g., nitrogen) in the chamber 110 escapes through the opening 101. The chamber 110 then fills up with tubing fluid to equalize pressure above and below the operator mandrel 114. This allows a shifting tool to open and close the valve 18*a* in subsequent operations.

To ensure that the pressure in the FIV bore 108 is at or below the formation pressure under the ball valve 18*a*, shear pins 120 connect the operator mandrel 114 to a sleeve 121. When the operator mandrel 114 and power mandrel 122 initially move downwardly, the sleeve 121 hits against a shoulder 123 in the first housing section 112 to prevent further movement of the operator and power mandrels. By bleeding away the tubing string bore pressure (and thus the FIV bore pressure), a sufficiently large pressure differential can be created between the gas chamber pressure and the fluid chamber pressure in the FIV 18 to shear the shearing pins 120. Once the shearing pins 120 are sheared, the operator mandrel and power mandrel can drop down. By ensuring a low FIV bore pressure less than the formation pressure below the valve 18*a*, damage can be avoided to the formation below the valve 18*a* when the valve 18*a* is reopened.

If desired, the tubing bore fluid pressure can also be maintained at a high enough level that the shearing pins 120 are not sheared. As a result, down movement of the power mandrel 122 to engage the valve operator 18*b* is prevented. If the tubing bore fluid pressure is not dropped low enough, then the valve 18*a* is not opened. This effectively resets the counter mechanism 200 on the next pressure up cycle. To activate the power mandrel again, the predetermined number of cycles must be reapplied to the counter mechanism.

The down movement of the power mandrel 122 causes its bottom part 172 to contact the top part of the latch mandrel 176. This moves the latch mandrel 176 to thereby actuate the ball valve 18*a*.

The tripsaver counter mechanism 200 in the FIV 18 allows one to, for example, pressure test tubing against the closed ball valve multiple times without cycling the ball valve open. This provides a great deal of flexibility downhole to alter the planned operations if required.

Alternatively, the valve can be closed and opened with a shifting tool run on the tubing, wireline, or coil tubing giving a redundant means of operating the valve to tubing pressure. The shifting tool is run at the end of the tool (e.g., perforating gun) string and includes a bi-directional collet and upper and lower centralizers. Pulling out of the hole the shifting tool collet engages with the latch profile and pulls the latch out of the detent closing the ball valve. The shifting tool disengages from the latch fingers once the ball is fully closed. Running in the hole the shifting tool collet engages with the latch profile and pushes the latch out of detent opening the ball valve. The ball valve opens every time the shifting tool is run through it and closes when pulled out of it. A uni-directional collet with shifting tool is run in to open the ball valve in case it can not be opened with tubing pressure. This collet will open the ball running in but does not close the ball pulling out. A detailed description of how a shifting tool actuates a ball valve is provided in the following applications, which are both owned by the same assignee of the present application and both incorporated herein by reference: U.S. patent application Ser. No. 08/646,673, entitled "Formation Isolation Valve Adapted for Building a Tool String of any Desired Length Prior to Lowering the Tool String Downhole for Performing a Wellbore Operation," filed on May 10, 1996; and U.S. patent application Ser. No. 08/762,762, entitled "Surface Controlled Formation Isolation Valve Adapted for Deployment of a Desired Length of a Tool String in Wellbore," filed on Dec. 10, 1996.

An optional spring loaded lock 133 (FIG. 5B) can be included in the FIV 18 adjacent the power mandrel 122. When the power mandrel 122 moves down to engage the latch mandrel 176 of the ball operator 18*b*, the spring loaded lock is pushed into a groove 135 initially located higher up on the power mandrel 122. Once locked, the power mandrel 122 cannot be moved by subsequent operations, thereby locking the valve 18*a* in an open position.

The FIV according to embodiments of the invention has many uses and advantages. For example, some wells are completed with other than cemented liner, i.e. the reservoir is exposed while top hole completion is run. In such a case, the formation might be damaged beyond repair due to the invasion of the completion fluid. If an FIV is installed at the top of the liner, it can be used as a barrier to keep the reservoir section isolated and protected. If the FIV is set in shallow depth up to 600 meters, it can be controlled via a control line with nitrogen, then the valve can be used as a second safety valve.

The FIV has an advantage that it can be tested from above as well as from below because it is a ball valve as compared to flapper-type safety valve. Some of the traditional wireline works can be avoided or minimized by using appropriate downhole valve technology which will reduce rig time, cost and risks associated with wireline works. As multi-lateral wells become common with the advancement of drilling and completion technologies, full bore ball valves will be an important component for well control, intervention, production and reservoir management in intelligent completion systems used in such multi-lateral wells.

Additionally, the FIV can be used to isolate wellbore sections so that a wellbore tool string of any desired length may be made up in the first section prior to opening the valve. The tool string can be lowered into the second section of the wellbore for performing one or more wellbore operations downhole in the second section.

Further, the FIV according to embodiments of the present invention can be used for isolating the formation from a portion of the wellbore above the formation by, e.g., positioning in a wellbore above the formation a valve assembly having a fluid conduit capable of the passage of tools therethrough and into the zone to be isolated and capable of allowing or preventing fluid communication within the wellbore between the wellhead and the formation.

Embodiments of the invention may also have one or more of the following advantages. By using a trip saver section, tubing pressure can operate the valve, thereby avoiding the need for a trip downhole for valve operation. The counter section associated with the valve allows other operations to be performed downhole before the valve is activated. The valve is multi-cycled and can be opened and closed as often as desired. Even after activating the trip saver, the valve can be subsequently opened and closed mechanically by a shifting tool.

Other embodiments are within the scope of the following claims. For example, although a specific valve mechanism is described, other types of valves and valve operator mechanisms can be used with a counter section 200 according to an embodiment of the invention.

Although the present invention has been described with reference to specific exemplary embodiments, various modifications and variations may be made to these embodiments without departing from the spirit and scope of the invention as set forth in the claims.

What is claimed is:

1. Apparatus for operating a valve positioned in a wellbore, comprising:

a valve operating member;

a first chamber;

a piston moveable from a first position to a second position by predetermined pressure applied from fluid in the first chamber; and a counter mechanism coupled to the piston to prevent movement of the piston to the second position until the predetermined fluid pressure has been applied a first number of times, wherein the piston moves between the first position and a third position in response to application and removal of the predetermined fluid pressure, the piston engaging the valve operating member to move the valve operating member in the second position but not engaging the valve operating member in the first or third position.

2. The apparatus of claim 1, further comprising a chamber filled with a gas to provide a reference pressure for the piston.

3. The apparatus of claim 2, wherein the piston is adapted to move in response to a pressure difference between the applied fluid pressure and the reference pressure.

4. The apparatus of claim 2, wherein the piston includes a first mandrel in communication with the applied fluid pressure and a second mandrel connected to the first mandrel in communications with the reference pressure.

5. The apparatus of claim 1, wherein the piston moves to the second position after a predetermined number of cycles in which the piston has been activated to move between the first and third positions.

6. The apparatus of claim 1, wherein the counter mechanism includes a predetermined number of slots and a pin that tracks along adjacent slots in response to movement of the piston between the first and third positions.

7. The apparatus of claim 6, wherein one or more first slots have a first length and one or more second slots have a second length, the second length being greater than the first length.

8. The apparatus of claim 7, wherein the piston is allowed to move to the second position when the pin engages a slot of the second length.

9. The apparatus of claim 7, wherein the slots include J slots defined along the circumference of the piston.

10. The apparatus of claim 7, wherein the slots are defined along the circumference of the piston, and wherein the counter mechanism further includes a sleeve that is rotatable with respect to the piston, the pin inserted through the sleeve to engage one of the slots.

11. The apparatus of claim 10, wherein the sleeve is rotated a first distance when the piston is cycled once between the first and third positions.

12. The apparatus of claim 1, further comprising a shear pin coupled to the piston to ensure that the piston does not move to the third position until a sufficiently low pressure exists in the tubing bore.

13. The apparatus of claim 12, further comprising a second chamber to provide a reference pressure for the piston, wherein the shear pin has a predetermined shear strength adapted to be sheared by a predetermined pressure differential between the first chamber pressure and the reference pressure.

14. The apparatus of claim 12, wherein the counter mechanism is reset if the sufficiently low pressure is not applied.

15. The apparatus of claim 1, further comprising a gap between the piston and the valve operating member.

16. The apparatus of claim 15, wherein the piston traverses the gap to engage the valve operating member when the piston moves to the second position.

17. A formation isolation valve, comprising:

a valve;

a housing having a bore;

a piston contained in the housing and operably coupled to the valve, the piston adapted to cycle between a first position and a second position in response to application and removal of predetermined pressure applied from fluid in the housing bore; and a counter mechanism coupled to the piston, including a sleeve having a protruding portion that prevents movement of the piston to a third position, the sleeve rotatable with respect to the piston in response to each cycle of the piston, wherein after a number of piston cycles the protruding portion of the sleeve is moved to a location that allows the piston to move to a third position to engage the valve.

18. The formation isolation valve of claim 17, wherein the piston includes a flange portion that engages the protruding portion of the sleeve except when the sleeve is rotated to a predetermined position.

19. The formation isolation valve of claim 18, wherein the counter mechanism further includes slots defined along the circumference of the piston and a pin inserted through the sleeve to engage one of the slots.

20. The formation isolation valve of claim 19, wherein the pin tracks along adjacent slots as the sleeve is rotated.

21. The formation isolation valve of claim 20, wherein a first number of slots have a first length and a second number of slots have a second length, the second length being greater than the first length, the piston being allowed move to the third position when the pin engages a slot having the second length.

22. The formation isolation valve of claim 21, wherein the slots include J slots.

23. A method of operating a valve positioned in a wellbore having a tubing with a bore, the method comprising:

applying a predetermined fluid pressure in the tubing bore;

removing the predetermined fluid pressure from the tubing bore;

performing the applying and removing steps a predetermined number of times;

moving a valve operator operably coupled to the valve between a first position and a second position in response to the applied predetermined fluid pressure;

activating a counter mechanism coupled to the valve operator to prevent movement of the valve operator to a third position until the predetermined fluid pressure has been applied a first number of times, the valve operator engaging the valve to actuate the valve in the third position but not engaging the valve in the first or second position.

24. Apparatus for operating a valve positioned in a wellbore, comprising:

a first chamber;

a valve operator coupled to the valve, the valve operator moveable from a first position to a second position by predetermined pressure applied from fluid in the first chamber; and a counter mechanism coupled to the valve operator to prevent movement of the valve operator to the second position until the predetermined fluid pressure has been applied a first number of times, the valve operator engaging the valve in the second position, the counter mechanism being reset if the predetermined fluid pressure is less than a first level; and a chamber filled with a gas to provide a reference pressure for the valve operator.

25. The apparatus of claim 24, where in the applied fluid pressure in the first chamber is greater than the reference pressure to move the valve operator.

26. Apparatus for operating a valve positioned in a wellbore, comprising:

a first chamber;

a valve operator coupled to the valve, the valve operator moveable from a first position to a second position by predetermined pressure applied from fluid in the first chamber; and a counter mechanism coupled to the valve operator to prevent movement of the valve operator to the second position until the predetermined fluid pressure has been applied a first number of times, the valve operator engaging the valve in the second position;

a shear member coupled to the valve operator to prevent the valve operator from moving to its second position until a predetermined pressure exists in the first chamber; and a chamber to provide a reference pressure for the valve operator, wherein the shear member has a predetermined shear strength, and wherein a pressure differential between the first chamber pressure and the reference pressure is adapted to shear the shear member.

27. The apparatus of claim 26, wherein the counter mechanism is reset if the predetermined pressure is not applied.

* * * * *